US005094157A

United States Patent [19]

Challis et al.

[11] Patent Number: 5,094,157

[45] Date of Patent: Mar. 10, 1992

[54] CAN CRUSHING MACHINE

[75] Inventors: George Challis, Ongar; William J. Craske, Chigwell, both of England

[73] Assignees: J. M. Challis; W. J. Nicholls, both of Essex, England

[21] Appl. No.: 568,070

[22] Filed: Aug. 16, 1990

[30] Foreign Application Priority Data

Aug. 18, 1989 [GB] United Kingdom ..... 8918876
Apr. 4, 1990 [GB] United Kingdom ..... 9007582

[51] Int. Cl.[5] ..... B30B 9/32; B30B 15/14; B30B 15/30

[52] U.S. Cl. ..... 100/53; 100/91; 100/137; 100/215; 100/902

[58] Field of Search ..... 100/53, 91, 137, 215, 100/218, 902

[56] References Cited

U.S. PATENT DOCUMENTS

| | | | |
|---|---|---|---|
| 3,732,804 | 5/1973 | Moller | 100/137 X |
| 4,091,725 | 5/1978 | Arp | 100/91 X |
| 4,141,493 | 2/1979 | Arp | 100/53 X |
| 4,291,618 | 9/1981 | Heiser et al. | 100/902 X |
| 4,358,994 | 11/1982 | Talley | 100/902 X |
| 4,373,435 | 2/1983 | Grevich | 100/902 X |
| 4,403,545 | 9/1983 | Toburen et al. | 100/902 X |
| 4,436,026 | 3/1984 | Imamura et al. | 100/91 X |
| 4,463,844 | 8/1984 | Huffman et al. | 100/902 X |

FOREIGN PATENT DOCUMENTS

| | | | |
|---|---|---|---|
| 3149799 | 9/1982 | Fed. Rep. of Germany | 100/902 |
| 58-23598 | 2/1983 | Japan | 100/902 |
| 58-93597 | 6/1983 | Japan | 100/902 |
| 58-145398 | 8/1983 | Japan | 100/902 |
| 59-85399 | 5/1984 | Japan | 100/902 |
| 60-6297 | 1/1985 | Japan | 100/902 |
| 61-216898 | 9/1986 | Japan | 100/902 |

*Primary Examiner*—Harvey C. Hornsby
*Assistant Examiner*—Stephen F. Gerrity
*Attorney, Agent, or Firm*—Iandiorio & Dingman

[57] ABSTRACT

A can crushing machine comprising a first crusher device (14, 15) for crushing a can (2) from a side of the can (2) such that a first side (2a) of the can (2) is forced towards a second side (2b) of the can (2) and such that ends (2c, 2d) of the can (2) are caused to pivot inwardly towards each other and towards the second side (2b), a second crusher device (10) for acting on the pivoted ends (2c, 2d) of the can (b 2) to further crush the can (2), a magnetic separator (45, 46, 39) for holding steel based cans but not aluminium based cans whereby the magnetic separator (45, 46, 39) is able to separate steel based cans from the aluminium based cans during use of the can crushing machine, and an adjuster device (70, 89) for moving all cans placed in the can crushing machine against a stop member (93).

7 Claims, 7 Drawing Sheets

CAN CRUSHING MACHINE

BACKGROUND OF THE INVENTION

This invention relates to a can crushing machine. Large quantities of products are now sold in cans. The products may be drinks such for example as alcoholic and soft drinks, or the products may be various different types of foods such as example as soups and vegetables. The cans are bulky and they are difficult to dispose of.

It is an aim of the present invention to provide a can crushing machine for use in the disposal of cans.

SUMMARY OF THE INVENTION

Accordingly, this invention provides a can crushing machine comprising first crusher means for crushing a can from a side of the can such that a first side of the can is forced towards a second side of the can and such that ends of the cans are caused to pivot inwardly towards each other and towards the second side, second crusher means for acting on the pivoted ends of the can to further crush the can, and magnetic separator means for holding steel based cans but not aluminium based cans whereby the magnetic separator means is able to separate the steel based cans from the aluminium based cans during use of the can crushing machine.

The separated steel based cans and the aluminium based cans can be collected separately and sold for their different scrap values, and such re-claiming of the cans can help to avoid much environmental pollution which is currently caused by discarded cans.

The can crushing machine of the present invention reduces the effort required in crushing cans by crushing each can in two stages, firstly with the first crusher means and secondly with the second crusher means. This two stage crushing of the cans requires much less force than would be required to crush the cans directly, either by collapsing them from end to end or by collapsing them from side to side. The high forces required to crush cans directly are due to the fact that the cans are mainly composed of thin metal, typically 0.1 mm thick, but they are designed to be very stiff and they are provided with thick rims at each end which are shaped to resist easy distortion. With the can crushing machine of the present invention, the cans are crushed by two separate steps which are in themselves quite easy to accomplish and which do not require anything like the high collapsing forces that would be required to crush the cans directly.

Preferably, the second crusher means acts on the pivoted ends of the can to further crush the can by forcing the pivoted ends flat against the second side. Alternatively however, the second crusher means may act on the pivoted ends of the can to further crush the can by forcing the pivoted ends toward each other.

The first crusher means is preferably two rods. Other first crusher means such for example as a single member or three rods may be employed.

The second crusher means is preferably a plate member. Other types of second crusher means may however be employed.

Preferably, the first and the second crusher means operate with a sliding action. The first and the second crusher means may operate on slide rods. The first and the second crusher means may however alternatively operate with an action other than a sliding action so that they may operate, for example, with a parallelogram link action.

The can crushing machine may be one in which the magnetic separator means is an electromagnetic separator means, and in which the can crushing machine includes shelf means for receiving the steel based cans and the aluminium based cans, and an exit aperture in the shelf means through which the steel based cans and the aluminium based cans fall under gravity, the shelf means being slideable with the second crusher means so that the exit aperture occupies a first position at which the aluminium based cans fall through the exit aperture and a second position at which the steel based cans fall through the exit aperture.

The can crushing machine may include adjustor means for moving all cans placed in the can crushing machine against a stop member and moving the first crusher means to cause it to crush the cans always at the same distance from each end of the cans irrespective of the length of the cans.

The adjustor means may comprise a finger member for engaging and moving the cans against the stop member, and a break clutch device for moving the first crusher means and the finger member.

The can crushing machine may include a housing, a feed opening through which the steel based cans and the aluminium based cans are fed to the crushing machine, closure means for closing the feed opening when the can crushing machine is not receiving a can, and inhibit means for preventing operation of the can crushing machine when the closure means is opened.

The can crushing machine of the present invention may be manually operated. Such a can crushing machine may include a hand pull lever for effecting the crushing of the can.

Alternatively, the can crushing machine of the present invention may be electrically operated. Such a can crushing machine may have an electric motor and it may operate automatically, for example on the press of a button.

The can crushing machine of the present invention can be installed at a variety of positions to make the collection of cans and their re-cycling more convenient. Small can crushing machines can be available in homes for domestic use. Thus persons in homes are able to collect the cans, store them and subsequently re-sell them for their scrap value. With large can crushing machines, such machines may be placed in public places where the public may bring their cans for crushing. The crushed cans could then be retained by the persons bringing them or they could be fed into appropriate containers for re-cycling and possible sale for their scrap value with any money obtained going to charity. Aluminium based cans will usually have a higher scrap value than steel based cans. Irrespective of whether the can crushing machines are large or small and irrespective of where they are placed, it will be apparent that the can crushing machines provide an incentive for people to retain their cans and not to throw them away. This in turn is able to provide the considerable advantage of a reduced number of cans causing environmental pollution.

BRIEF DESCRIPTION OF THE DRAWINGS

Embodiments of the invention will now be described solely by way of example and with reference to the accompanying drawings in which.

DESCRIPTION OF THE PREFERRED EMBODIMENTS

Figure 1:
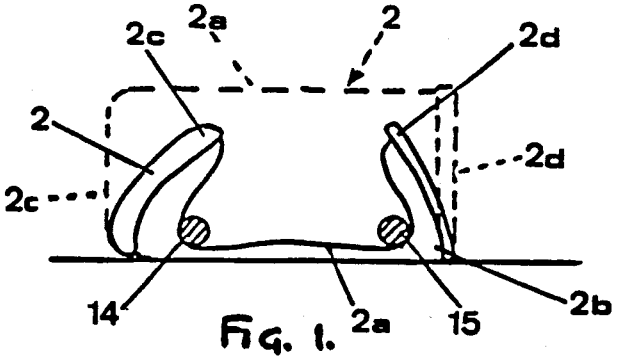
FIG. 1 illustrates the crushing of a can from a side of the can using first crushing means.

Referring to FIG. 1, there is shown a can 2 which is shown in an uncrushed position in dotted lines and which is shown in a partially crushed position in full lines. In the partially crushed position, it will be seen that a first side 2*a* has been crushed towards a second side 2*b* of the can 2. The crushing has been effected by first crusher means in the form of rods 14, 15 and the crushing is such that ends 2*c* and 2*d* have been caused to pivot inwardly towards each other and towards the second side 2*b*.

Figure 2:
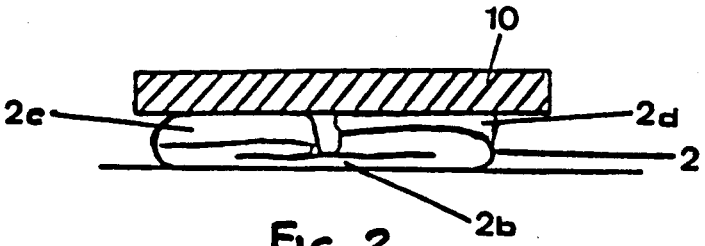
FIG. 2 illustrates the crushing of the ends of the can using second crusher means.

Referring now to FIG. 2, there is shown the can 2 which has been completely crushed by second crusher means in the form of a plate 10. It will be seen that the plate 10 has acted on the inwardly pivoted ends 2*c*, 2*d* of the can 2 and has crushed the pivoted ends 2*c*, 2*d* of the can 2 flat against the second side 2*b*. In the crushed assembly of the can 2 as shown in FIG. 2, it will be seen that the ends 2*c*, 2*d* are also crushed against the first side 2*a* since the first side 2*a* has been crushed by the rods 14, 15 against the second side 2*b*.

It will be appreciated from a consideration of FIGS. 1 and 2 that the crushing of the can 2 has been accomplished by a means of simple leverage. This crushing of the can 2 is much easier and much less force is required than if the can 2 were to be crushed directly either by collapsing from end to end or from side to side. As can be seen from FIG. 1, the first crushing step acts on the thin side walls of the can 2. As can also be seen from FIG. 2, the second crushing step merely involves continuing the inward folding of the ends 2*c*, 2*d* of the can 2.

Figure 3:
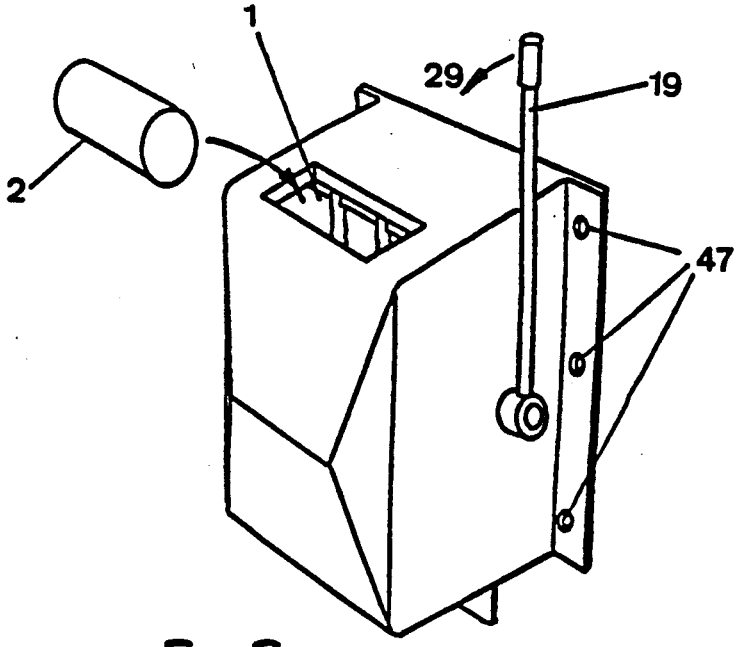
FIG. 3 is a perspective view of a first can crushing machine.
Figure 4:
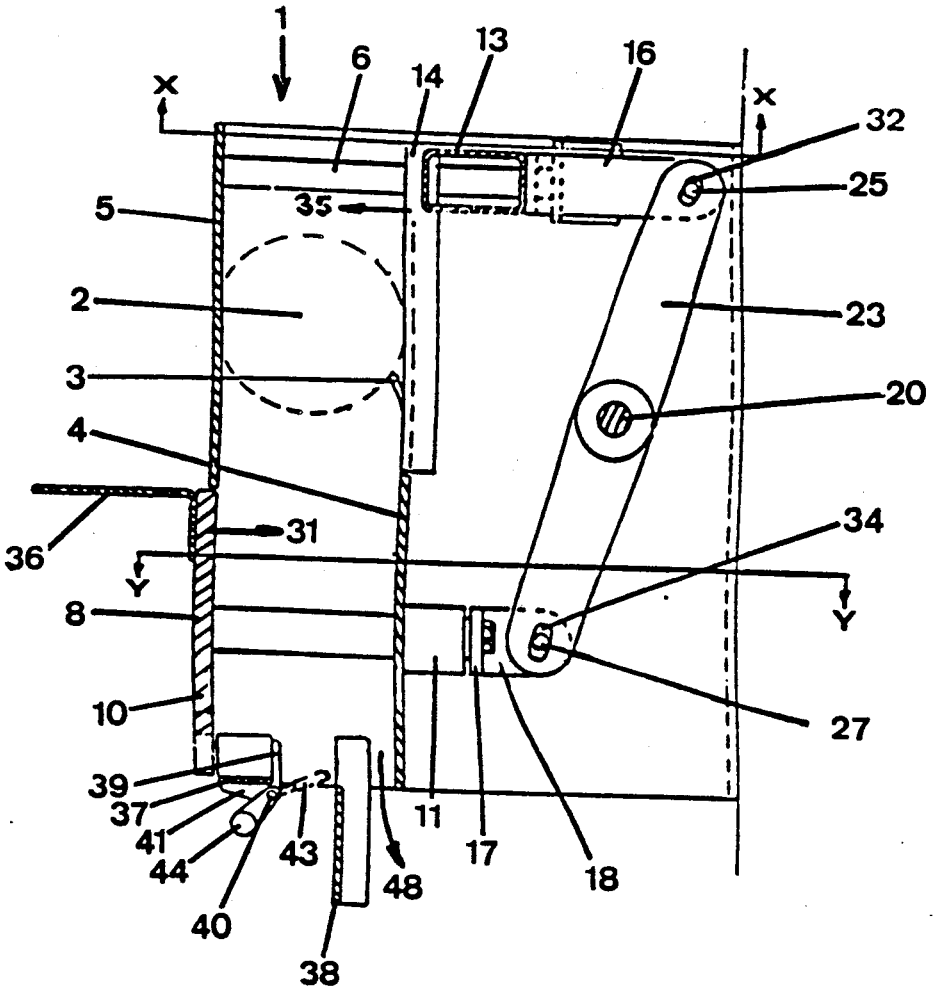
FIG. 4 is a vertical cross section through the machine shown in FIG. 3 with the cover of the machine removed.
Figure 5:
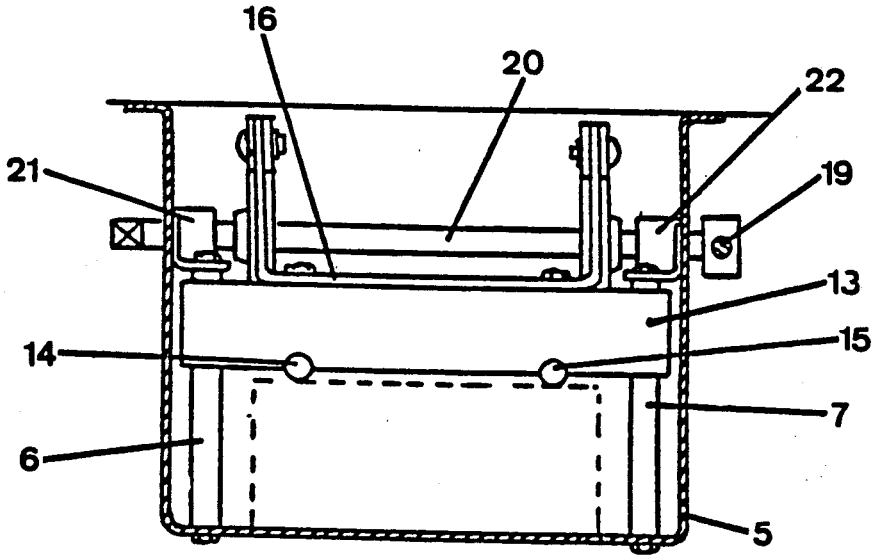
FIG. 5 is a horizontal cross section on line X—X shown in FIG. 4.
Figure 6:
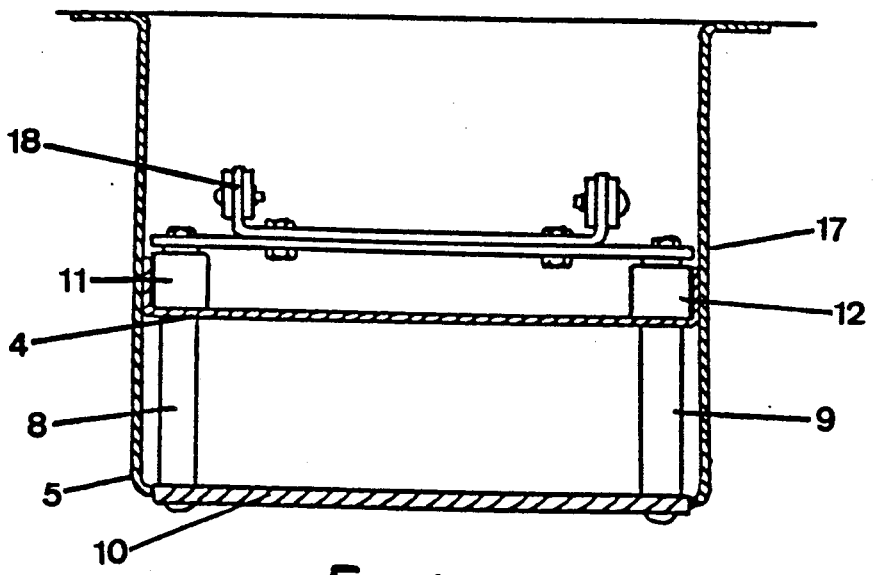
FIG. 6 is a horizontal cross section on line Y—Y shown in FIG. 4.
Figure 7:
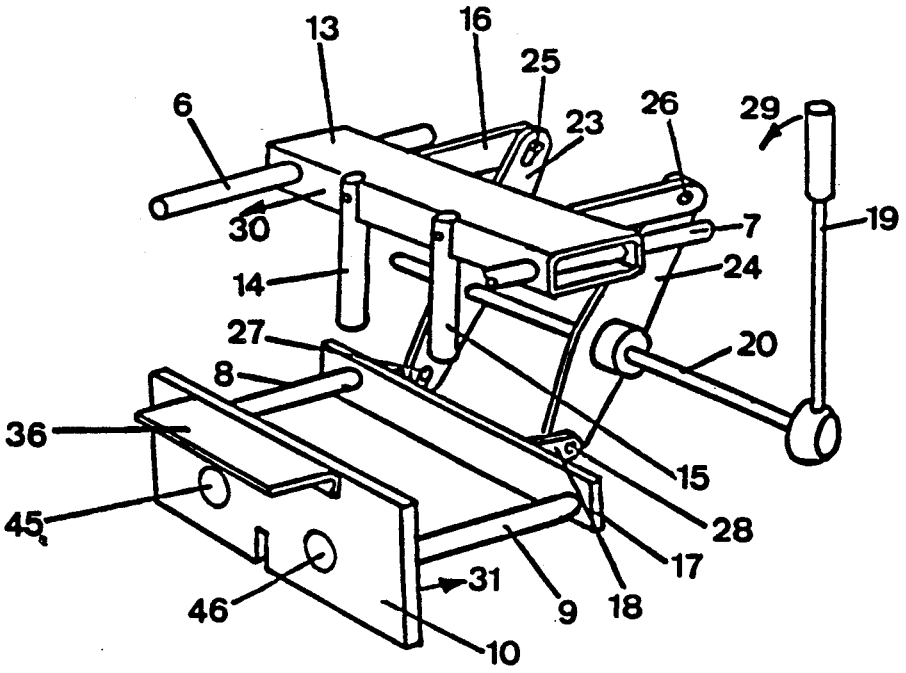
FIG. 7 is a perspective view of moving elements forming part of the machine shown in FIG. 4.
Figure 8:
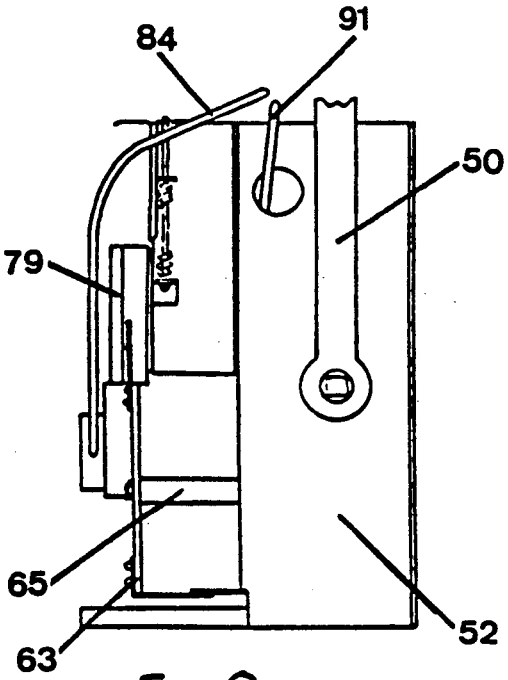
FIG. 8 is a view from the right side of a second can crushing machine.
Figure 9:
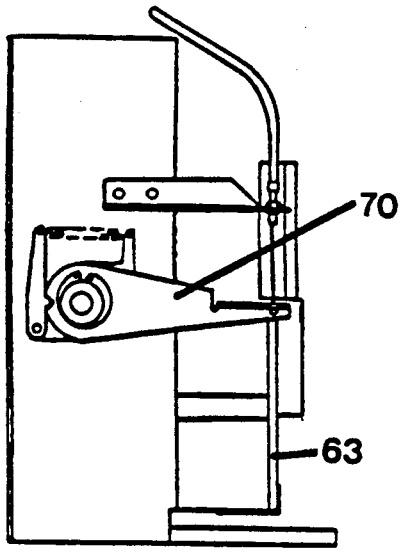
FIG. 9 is a view from the left hand side of the can crushing machine shown in FIG. 8.
Figure 10:
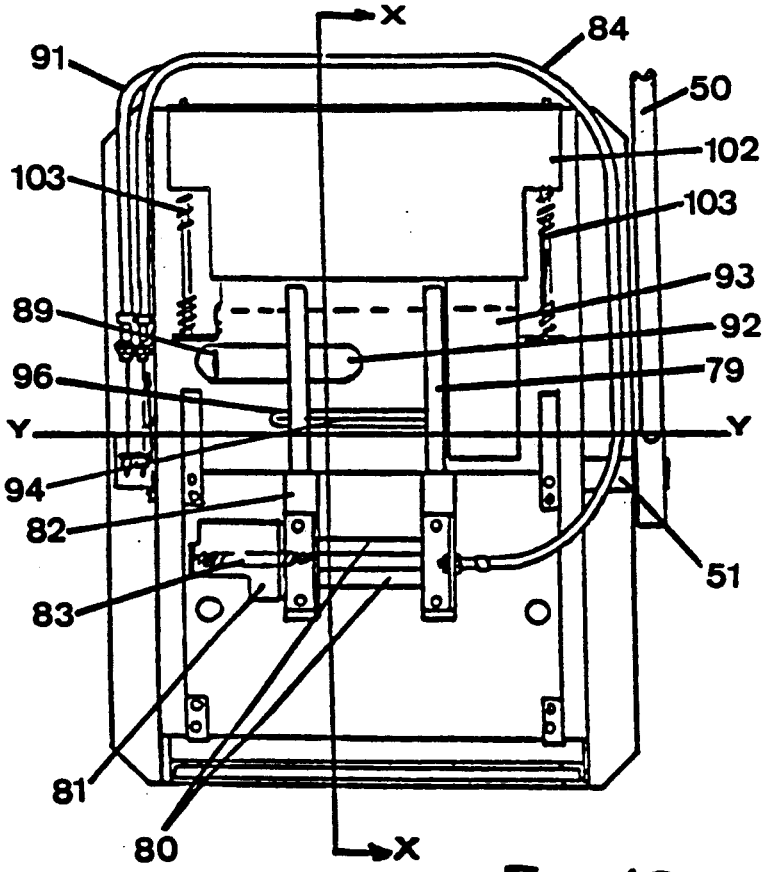
FIG. 10 is a front view showing part of the can crushing machine shown in FIG. 8.
Figure 12:
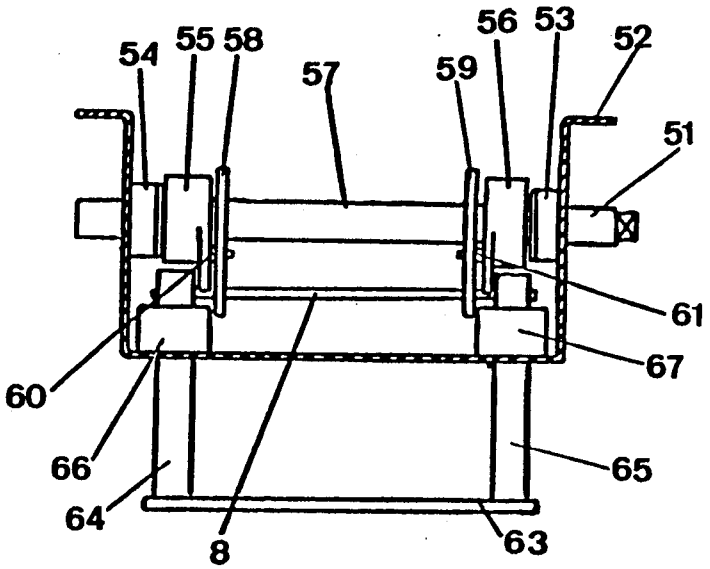
FIG. 12 is a section on the line Y—Y shown in FIG. 10 with some parts being omitted for clarity of illustration.
Figure 11:
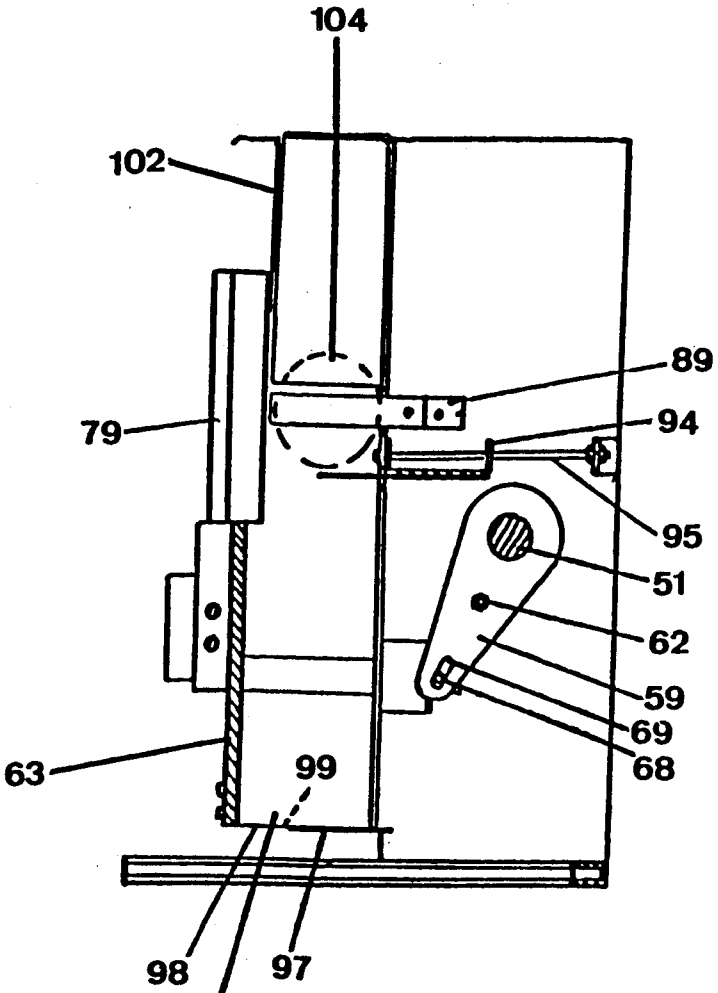
FIG. 11 is a section on the line X—X shown in FIG. 10.
Figure 13:
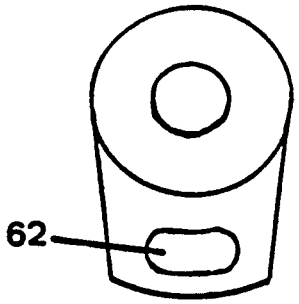
FIG. 13 shows a toggle link forming part of the second can crushing machine.
Figure 14:
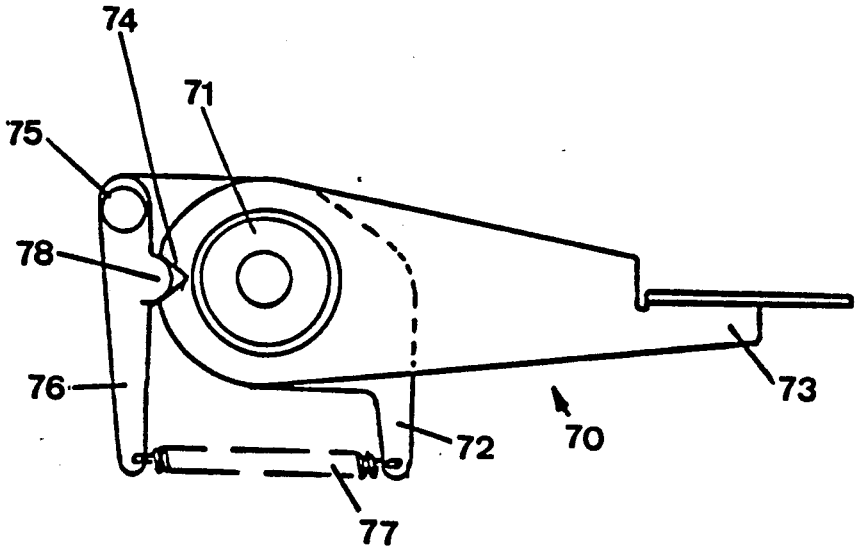
FIG. 14 shows a break link assembly.
Figure 15:
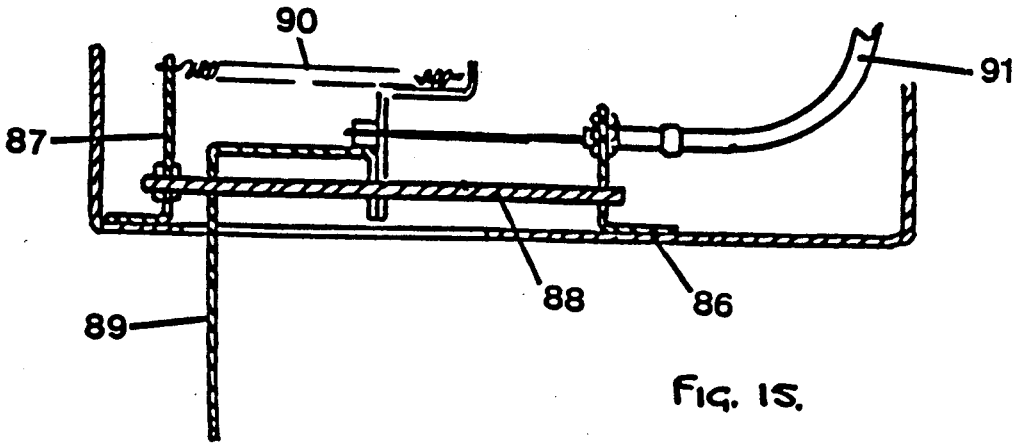
FIG. 15 is a horizontal section showing a locating finger member forming part of the second can crushing machine.
Figure 16:
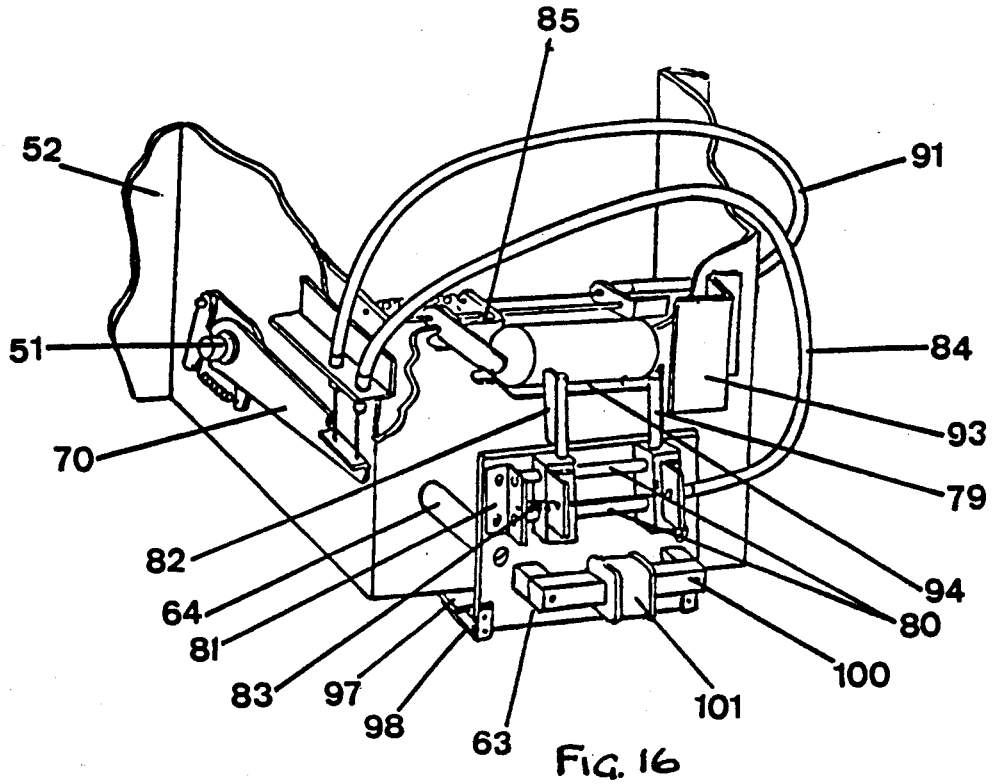
FIG. 16 is a perspective view from the front and the left side and shows some parts of the second can crushing machine.

Referring now to FIGS. 3 to 7, there is shown in FIG. 3 a can 2 being fed into a can crushing machine through an aperture 1. The downward fall of the can 2 is arrested as shown in FIG. 4 by a projection 3. The projection 3 forms part of a partition 4 which is fixed within a housing 5 of the can crushing machine.

Also provided within the housing 5 are slide rods 6, 7. These slide rods 6, 7 are attached at each end to the top of the housing 5.

Slide rods 8, 9 are also provided within the housing 5. These slide rods 8, 9 are provided towards the bottom of the housing 5 and they are attached to second crusher means in the form of a moving plate 10. The slide rods 8, 9 are guided by linear bearings 10, 11 which are attached to the partition 4.

A crossbar 13 is slideably mounted on the slide rods 6, 7. As mentioned above, the first crusher means is formed by the rods 14, 15 and these vertical rods 14, 15 are attached to the crossbar 13. A bracket 16 is provided at the rear of the crossbar 13.

The slide rods 8, 9 are connected together at their rear ends by a bar 17 which is attached to a bracket 18.

An arm 19 is attached to a shaft 20. The shaft 20 is supported within the housing 5 by bearings 21, 22.

Toggle links 23, 24 are attached to the shaft 20. The upper ends of the toggle links 23, 24 are connected to the bracket 16 by means of pins 25, 26 passing through slots 32, 33. The lower ends of the toggle links 23, 24 are connected to the bracket 18 by means of pins 27, 28 passing through slots 34, 35.

When the arm 19 is pulled in the direction of arrow 29, the toggle links 23, 24 rotate. This causes the crossbar 13 to move in the direction of arrow 30, and it also causes the plate 10 to move in the direction of arrow 31.

An angle plate 36 is attached to the plate 10. A horizontal strip 37 is attached to the bottom of the housing 5. A vertical separating strip 38 is attached to the body 5. An ejector arm 39 is pivoted at pivot 40 to a bracket 41. The bracket 41 is attached to the horizontal strip 37 at the mid point of the horizontal strip 37.

During operation of the machine 2, the ejector arm 39 can be rotated in the direction of arrow 42 to the position 43. The ejector arm 39 cannot be moved in the other direction. A balance weight 44 causes the arm 39 to return to the upright position after any displacement.

The plate 10 is formed on a non-magnetic material. Magnets 45, 46 are contained within the plate 10.

Holes 47 are provided in each side of the housing 5 for enabling the can crushing machine to be attached to a suitable support surface such for example as a wall.

The can crushing machine operates as follows. When the can 2 has been inserted into the aperture 1, it falls as far as the position shown in FIG. 4, where the can 2 is held by the projection 3.

On pulling the handle 19, the rods 14, 15 deform the can against an inner face of the housing 5. The can is then deformed into the shape shown in FIG. 1. At the same time, the plate 10 is pulled towards the partition 4, without at this stage doing any other action. However, this movement of the plate 10 causes the single plate 36 to close the aperture below the partially crushed can 2.

On releasing the handle 19, the partially crushed can 2 becomes loose and drops downwards away from the rods 14, 15. The partially crushed can 2 drops downwards until it lodges on the angle plate 36. The paritally crushed can 2 remains on the angle plate 36 until the plate 10 returns to its rest position. When this happens, the partially crushed can 2 drops further down until it lodges on the horizontal strip 37.

When the next an 2 is inserted into the can crushing machine and the handle 19 is pulled, the action of the rods 14, 15 is repeated. However, this time, movement of the plate 10 towards the partition 4 completes the crushing of the can 2.

As the plate 10 moves across, taking the crushed can 2 with it, the ejector arm 39 is moved to the position 43. After both the plate 10 and the can 2 have passed the ejector arm 39, the ejector arm 39 flips back to its upright position.

The crushed can may be made of aluminium or steel. If the crushed can is made of aluminium, the moment the pressure on the arm 13 is released, the arm 13 returns to its rest position and the crushed can drops straight down the right side of the separating strip 38, in the direction of arrow 49. If the crushed can is made of steel, then magnetic separator means in the form of the magnets 45, 46 cause the crushed can to remain with the plate 10. The crushed can is then stripped from the plate 10 by the ejector arm 39, whereupon the crushed can drops down the left side of the separating strip 38, in the direction of the arrow 49. Thus steel and aluminium cans are automatically separated out for collection.

In a modified form of the can crushing machine shown in FIGS. 3 to 7, both the collapsing and the crushing means may operate with a sliding action but the collapsing rods 14, 15 may be attached directly to the plate 10, moving with it in the same direction, and not in the opposite direction as shown in FIGS. 3 to 7. With this modified aciton, the plate 10 still moves on the guide rods 8, 9 and is operated by half length toggle links 23, 24 fixed to the shaft 20. The top halves of the toggle links 23, 24 are not longer required, nor are the top pair of sliding rods 6, 7, the crossbar 13 and the bracket 16.

Because of the large difference between the longest and shortest can currently sold, for example drink cans, it may be advantageous to adjust the relative position of the collapsing rods 14, 15 to ensure optimum action in each case. This may be done by fixing one of the collapsing rods 14, 15 to the plate 10, and slideably mounting the other collapsing rod 14, 15. As each can 2 is inserted into the hand crushing machine, the can 2 is moved sideways to a stop. This action also slides the moving arm into its correct position.

Referring to FIGS. 8–16, there is shown a can crushing machine having an operating handle 50 which is pulled when it is desired to crush a can. The handle 50 is attached to a drive shaft 51. The drive shaft 51 is supported in a body 52 by bearings 53, 54.

Two toggles 55,56 are securely attached to the drive shaft 51. A torque tube 57 is located between the two toggles 55, 56. At each end of the torque tube 57 is welded a transfer arm 58, 59. Attached to each transfer arm 58,59 is a pin 60,61. Each pin 60, 61 projects through a slot 62 in each toggle 55,56.

Second crusher means in the form of a crusher plate 63 is attached to slide rods 64,65. The slide rods 64,65 reciprocate in bearings 66,67 in the body 52. A rod 68 is connected between the slide rods 64,65 and passes through slots 69 in the transfer arms 58,59. The crusher plate 63 is manufactured from a non-magnetic material.

A break clutch assembly 70 is attached to one end of the drive shaft 51. The break clutch assembly 70 comprises a boss 71 secured to a base plate 72. An output arm 73 rotates on the boss 71. The output arm 73 contains a detent 74. A break arm 76 is pivotally attached to the base plate 72 at position 75. The break arm 76 is connected by a spring 77 to a base plate 72. The break arm 76 contains a projecting portion 78 which locates in the detent 74.

A collapsing rod 79 forms part of first crusher means and is secured to the outer face of the crusher plate 63. Two guides 80 are supported by the body of the crusher plate 63, the guides 80 being secured at their other ends by a bracket 81.

A second collapsing rod 82, also forming part of the first crusher means, is free to slide upon the guides 80. The second collapsing rod 82 is attached by means of a spring 83 to the bracket 81.

A sleeved cable 84 is connected between the sliding collapsing rod 82 and the break clitch output arm 73 such that when the output arm 73 rotates downwards, the sliding collapsing rod 82 is moved towards the fixed collapsing rod 79. When the output arm 73 is returned to its original position, the spring 83 ensures that the sliding collapsing rod 82 also returns in a similar way.

A locating finger assembly 85 is attached to the inside front face of the body 52. The locating finger assembly 85 comprises brackets 86,87 which are attached to the body 52 and which hold and secure a guide rod 88. A locating finger 89 is free to slide upon the guide rod 88. A spring 90 is attached to the bracket 87 and the locating finger 89.

A sleeved cable 91 is connected between the locating finger 89 and the output arm 73 such that when the output arm 73 roates downwards, the locating finger 89 slides to the right, moving within a slot 92 in the face of the body 52.

A stop/strip bracket 93 is attached to the front face of the body 52.

A moving shelf 94 is slideably mounted on rods 95. The moving shelf 94 projects through a slot 96 in the front face of the body 52.

A bottom shelf 97 is attached by means of brackets 98 to the crusher plate 63. A gap 99 is provided and this is positioned between the rear of the crusher plate 63 and the leading edge of the bottom shelf 97.

Attached to the outer face of the crusher plate 63 is a magnetic circuit 100, upon which is mounted a coil 101. The magnetic circuit 100 is secured to the crusher plate 63 by means of ferrous screws which present a flush finish on the crusher plate 63 inner surface.

Closure means in the form of a sprung hatch 102 slides on two guide rods 103 to permit cans to be inserted into the can crushing machine. When a can is inserted into the can crushing machine, the can falls until it rests on the moving shelf 94 as shown by the dotted circle 104. When the operating handle 50 is pulled, the break clutch assembly 70 is also rotated. However, because of the slots 62 in the toggles 55,56, the transfer arms 58,59 do not immediately follow suit.

Movement of the break clutch arm 73 causes the locating finger 89 to move to the right, until it presses the can against the inner face of the stop/strip bracket 93. At the same time, the collapsing rod 82 is moved to the right.

When the can can be moved no further, the moving finger is arrested and further rotation of the operating handle 50 causes the projection 78 on the break arm 76 to ride up in the detent 74, eventually disconnecting the break arm 76 from the base plate 72.

The break arm 76 now remains in its disconnected position regardless of further movement of the operating handle 50. However, in this position, the break arm 76 has also located the can and collapsing rod 82 in the optimum position for collapsing the can, regardless of the length of the can.

The movement in the can crushing machine so far described occurs as the drive pins 60,61 move through the slots 62 in the toggles 50,56, which are of a length sufficient to ensure that the moving collapsing rod 82 is located correctly for the shortest can. Once the drive pins 60,61 have moved through the slots 62, the pins 60,61 pick up the toggles 55,56 and, by means of these toggles 55,56, start the crusher plate 63 moving. This also moves the collapsing rods 79,82 towards the face of the body 52, collapsing the can. As this is done, the moving shelf 94 is moved from beneath the can so that when the crusher plate 63 and the collapsing rods 79,82 are returned to their rest position, the collapsed can is able to fall downwards until it rests on the shelf 97. At this stage, the moving shelf 94 is returned to its rest position.

When the next can is inserted, the action described is repeated. However, this time the can resting on the shelf 97 is also crushed flat as the crusher plate 63 moves inwardly.

Throughout the period of movement of the crusher plate 60, the electromagnet produced by the magnetic circuit 100 and the coil 101 is switched on. On the return of the crusher plate 63 to its rest position, the crushed can, if it is an aluminium based crushed can, falls straight through the slot 90 which forms an exit aperture. The crushed can may then be collected in a container placed beneath the slot 90.

If the can is a steel based can however, then the crushed can is retained against the inner face of the crusher plate 63 until the crusher plate reaches its rest position, at which stage the electromagnet is switched off. The steel based crushed can can then fall through the slot 90, but in a different location, beneath which location a second container is located for receiving the crushed steel based can. Thus the aluminium based cans and the steel based cans are separated out for individual collection so that they can then be sold for different scrap values.

Figure 17:
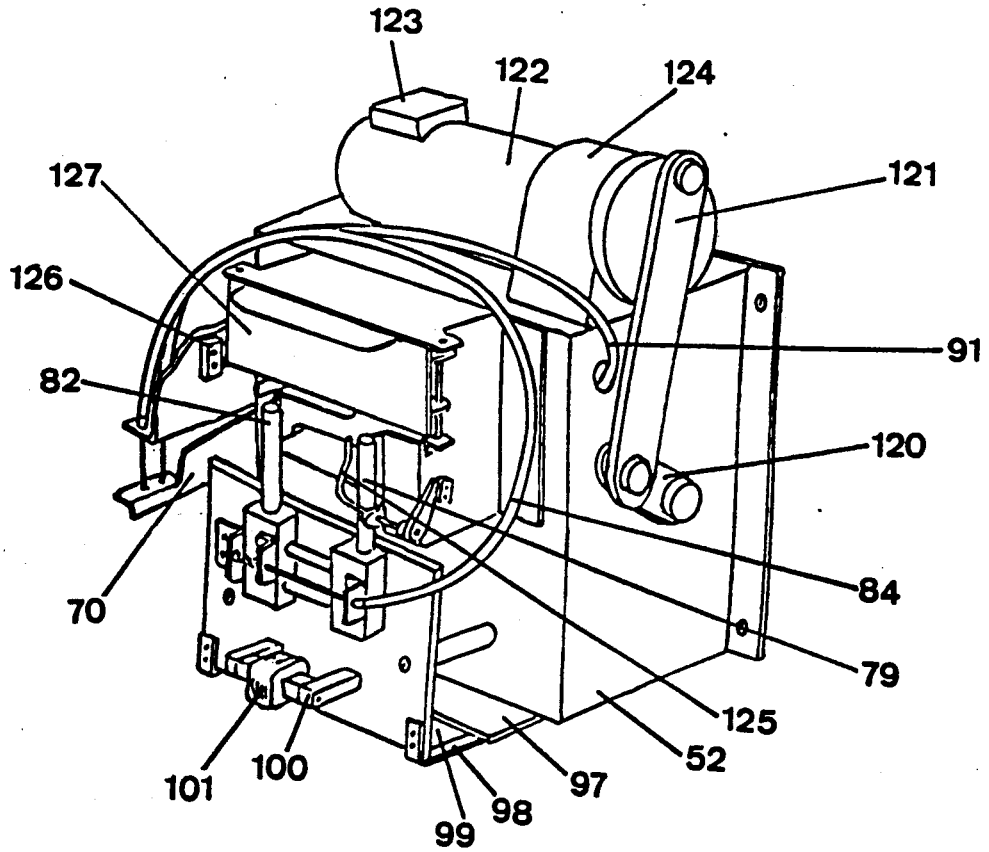
FIG. 17 is a perspective view from the front and the right hand side of a thrid can crushing machine.

Referring now to FIG. 17, there is shown a third can crushing machine which is similar to the second can crushing machine shown in FIGS. 8–16. Similar parts have been given the same reference numerals for ease of comparison and understanding. In FIG. 17, the can crushing machine does not have the operating handle 50 but instead has link members 120, 121 as shown. The link member 121 is driven by an electric motor 122 having an appropriate gear and drive mechanism. The electric motor 122 is held in position on the top of the body 52 by means of clamps 123,124.

It is to be appreciated that the embodimes of the invention described above with reference to the accompanying drawings have been given by way of exajmple only and that modifications may be effected. Thus, for example, the various illustrated moving elements may be moved using parallelogram link acting devices instead of slide rods. The second crusher means in the form of the moving plate 10 can be replaced by a second crusher means which crushes the can by forcing the pivoted ends 2c, 2d towards each other.

The can crushing machine can be made in any desired size depending upon where it is to be installed and used. Where the can crushing machine is to be electrically operated as in FIG. 17, then any appropriate electric motor and gearbox may be employed. A transformer for reducing mains voltage may advantageously be employed in order to make the can crushing machine safer for use.

The can crushing machine as illustrated in FIG. 17 may be started by pressing a button or a lever, or it may be foot operated. Preferably the electrically operated can crushing machine operates automatically once a can to be crushed is introduced into the can crushing machine. Although the brackets 98 are shown separately formed from the bottom shelf 97, any arrangement can be employed which causes the gap 98 effectively to be a gap in the bottom shelf 97.

FIG. 17 also shows preferred features of a can presence sensor in the form of a lever 125, and a safety switch 126 which inhibits the drive from the electric motor 122 when closure means in the form of a hatch 127 opens. If desired, the first can crushing mahine shown in FIGS. 4 to 7 can be provided with a can length adjusting mechanism as shown in FIGS. 8 to 16.

What is claimed is:

1. A can crushing machine comprising a housing, a feed opening in the housing for receiving cans to be crushed, first crusher means for crushing a can from a side of the can such that a first side of the can is forced towards a second side of the can and such that ends of the can are caused to pivot inwardly towards each other and towards the second side, second crusher means for acting on the pivoted ends of the can to further crush the can, magnetic separator means for holding steel based can but not aluminum based cans whereby the magnetic separator means is able to separate the steel based cans from the aluminium based cans during use of the can crushing machine, and adjustor means for moving all cans placed in the can crushing machine against a stop member positioned in the housing, the adjustor means comprises a can-engaging member for engaging and moving the cans against the stop member, and a break clutch device for moving the first crusher means and the can-engaging member.

2. A can crushing machine according to claim 1 in which the second crusher means acts on the pivoted ends of the can to further crush the can by forcing the pivoted ends flat against the second side.

3. A can crushing machine according to claim 2 in which the first crusher means is two rods and in which the second crusher means is a plate member.

4. A can crushing machine according to claim 1 in which the first and the second crusher means are sliding crusher means, and in which each sliding crucher means slides on a pair of slide rods.

5. A can crushing machine according to claim 4 in which the magnetic separator means is an electromagnetic separator means, and in which the can crushing machine includes shelf means which is positioned below the feed opening and hwich is for receiving the steel based cans and the aluminium based cans, and an exit aperture in the shelf means through which the steel based cans and the aluminium based cans fall under gravity, the shelf means being slideable with the second crusher means so that the exit aperture occupies a first position at which the aluminium based cans fall through the exit aperture and a second position at which the steel based cans fall through the exit aperture.

6. A can crushing machine according to claim 1 and including closure means for closing the feed opening when the can crushing machine is not receiving a can, and inhibit means for preventing operation of the can crushing machine when the closure means is opened.

7. A can crushing machine according to claim 1 and including an electric motor for driving the first and the second crusher means.

* * * * *